US006279905B1

(12) United States Patent
Malavazos et al.

(10) Patent No.: US 6,279,905 B1
(45) Date of Patent: Aug. 28, 2001

(54) SHUFFLEBOARD GAME WITH AIR CUSHION SUPPORTED PLAY PIECES

(76) Inventors: Alex J. Malavazos; Gregory A. Malavazos, both of 882 Meadow Vista, Carson City, NV (US) 89705

( * ) Notice: Subject to any disclaimer, the term of this patent is extended or adjusted under 35 U.S.C. 154(b) by 0 days.

(21) Appl. No.: 09/378,117

(22) Filed: Aug. 20, 1999

(51) Int. Cl.[7] ..... A63F 7/00
(52) U.S. Cl. ..... 273/126 A
(58) Field of Search ..... 273/126 R, 126 A, 273/118 R, 118 A, 119 R, 119 A, 108

(56) References Cited

U.S. PATENT DOCUMENTS

| | | | | |
|---|---|---|---|---|
| 3,572,717 | * | 3/1971 | Anguella | 273/126 R |
| 3,722,888 | * | 3/1973 | Ducharme | 273/126 R |
| 3,992,009 | * | 11/1976 | Trbovich | 273/126 R |
| 4,017,078 | * | 4/1977 | Goldfarb et al. | 273/126 A |
| 4,082,282 | * | 4/1978 | Trbovich | 273/126 R |
| 4,173,341 | * | 11/1979 | Olliges | 273/126 A |
| 5,110,128 | * | 5/1992 | Robbins | 273/126 A |
| 5,556,093 | * | 9/1996 | Lankiewicz et al. | 273/126 A |
| 5,876,262 | * | 3/1999 | Kelly et al. | 446/118 |
| 5,941,778 | * | 8/1999 | Vasalech | 473/1 |

OTHER PUBLICATIONS

Barton, Street Beat p. 22, Jul. 1997, Article entitled "Champion Takes The Prize With Modern Shuffleboard Tables", 1 page.
Playfair Sales, sales literature entitled "Playfair Shuffleboard" Aug. 1996, 1page.
American International Shuffleboard Corp, advertisement entitled "The Finest in Coin Op Billiards, Pool and Shuffleboards" Aug. 1996.

* cited by examiner

*Primary Examiner*—Raleigh W. Chiu
(74) *Attorney, Agent, or Firm*—Harris Zimmerman

(57) ABSTRACT

A horizontal playing field board along which players propel play pieces has end zones at which the pieces may come to rest. Air outflow through an array of apertures in the board levitates the play pieces except at the end zone that is opposite from the players. This substantially eliminates friction except at the end zone where the pieces come to rest. Following insertion of payment in commercial versions of the game, the air blower shuts down when a player attains a maximum score or after elapse of a predetermined time period regardless of the player's scores. The board is light transmissive enabling illumination from underneath. Markings at each end zone which identify areas of different score value are changeable images produced by electronic display screens. This enables player selection of any of a plurality of different games having different marking patterns.

13 Claims, 15 Drawing Sheets

FIG. 6
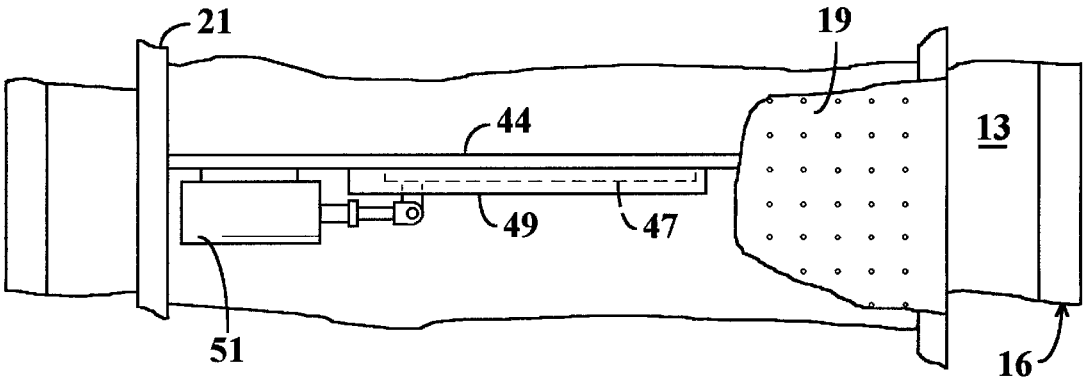
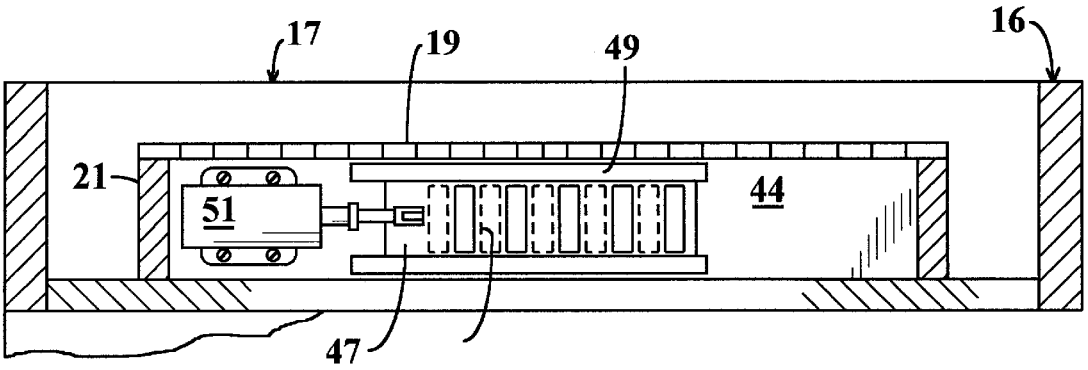
FIG. 5

SHUFFLEBOARD GAME WITH AIR CUSHION SUPPORTED PLAY PIECES

TECHNICAL FIELD

This invention relates to amusement devices and more particularly to gaming apparatus of the kind in which players propel play pieces along an elongated playing field surface towards a scoring zone which is demarcated into areas of differing score value.

BACKGROUND OF THE INVENTION

Traditional shuffleboard requires a lengthy playing field which has usually been demarcated on a floor, a paved surface or similar surfaces such as the decks of ships. Elongated tables on which shuffleboard is played have also been developed for use in game arcades or other indoor locations. Prior shuffleboard games have several characteristics which have tended to restrict their use and/or which have detracted from the player's enjoyment of the game.

Shuffleboard players slide play pieces along a playing field surface towards a scoring zone at the far end of the surface that is demarcated into areas of different score value. A player's score is determined by the sum of the score values of areas where the player's play pieces come to rest. As a matter of strategy competing player's may endeavor to dislodge an opponents play pieces from scoring areas. In conventional shuffleboard, motion of the play piece is gradually slowed by friction as it slides along the underlying surface. A skillful player must anticipate the rate at which such slowing will occur in order to cause the play piece to come to rest at an are a of high score value. Lengthy playing fields, typically at least 12 to 24 feet long, have been customary in order to make this operation sufficiently challenging to players.

It would be advantageous under many circumstances if the size of shuffleboard games could be kept to a minimum while retaining a high degree of challenge to the players. In commercial game arcades, for example, a shuffleboard table must compete for available space with a variety of other games.

Play pieces in conventional shuffleboard games are somewhat heavy in order to allow the player to impart sufficient momentum to the play piece to travel it along the full length of the playing field. The heavy play pieces abrade the surface of the playing field. This eventually interferes with smooth sliding of the play pieces and thereby detracts from the quality of the game. This complicates maintenance of the game as frequent resurfacing of the playing field may be needed to counteract the effect.

The shuffleboard playing field should be well illuminated in order to assure that field boundaries and demarcations on the field are clearly visible to players. Adequate lighting may not always be present at locations where it desired to situate a shuffleboard game. Some prior shuffleboard game tables resolve this problem by including lighting fixtures as a component of the table itself which fixtures are mounted on posts that extend upward at a side of the playing field. This makes the gaming apparatus still more bulky.

Shuffleboard tables typically have a scoreboard in the form of a display screen which indicates each players current score. Players enter their scores by operating electrical switch buttons. As in the case of lighting fixtures the scoreboards have typically been mounted on posts which extend upward at a side of the table thereby further contributing to the bulk of the gaming apparatus.

A major problem of prior shuffleboard games in commercial establishments that require entry of coins or other payment for a period of play has been playing or practicing of the game by persons who have not paid. This is possible as entry of coins at the table simply activates the electronic scoreboard display and the scoreboard is not a necessity for playing or practicing the game. Some prior shuffleboard tables address this problem by means of a row of pins which extend upward at the middle of the playing field. Deposit of a coin causes a temporary retraction of the pins.

Demarcations at the end regions of the playing field which separate the scoring zones into areas of different score value and numerals which indicate the score values have heretofore been permanently imprinted on the playing field surface. This limits any given shuffleboard game to a single form of play and a single scoring protocol.

Profitability of a gaming apparatus in commercial game arcades or the like is highly dependent on the ability of the game to attract the interest of potential players and to provide an exciting ambiance during playing of the game. Prior shuffleboard tables have been somewhat lacking in this respect.

The present invention is directed to overcoming one or more of the problems discussed above.

SUMMARY OF THE INVENTION

In one aspect the present invention provides gaming apparatus having an elongated playing field board with a horizontal upper surface along which a player propels a play piece. The playing field board has a play piece travel zone along which the play piece travels towards a first end zone at which it may come to rest. Different areas within the first end zone have different scoring values. At least a portion of the playing field board is penetrated by an array of spaced apart airflow apertures. At least one air blower has an airflow outlet communicated with the airflow apertures to cause an outflow of air through the apertures.

In another aspect of the invention the playing field board has a second end zone situated at the opposite end of the play piece travel zone from the first end zone. The array of airflow apertures extends along each end zone as well as along the play piece travel zone. The apparatus further includes means for selectively stopping airflow emission at either end zone while enabling airflow emission at the other thereof.

In another aspect of the invention at least a portion of the playing field board is formed of light transmissive material. The playing field is illuminated by at least one light source disposed beneath a light transmissive portion of the board.

In another aspect the gaming apparatus further includes a manually operable score counter at which players may enter their scores. A control circuit turns off the blower drive motor when a winning score value is reached. The control circuit also turns off the motor after a preset maximum period of operation without regard to the score values of the players.

In another aspect of the invention at least one visible demarcation divides the end zone of the playing field board into areas of different score value. The demarcation is a changeable image generated by an electronic display screen which is situated at the end zone.

In another aspect of the invention a display screen controller is coupled to the electronic display screen and is conditioned to cause display of any selected one of a plurality of different demarcation patterns at the end zone.

In another aspect the invention provides gaming apparatus having a plurality of play pieces for propelling along a playing field by a player and an elongated table having side portions and end portions bounding an elongated playing field region. A horizontal playing field board extends along the playing field region and is proportioned to be in spaced apart relationship with the side portions and end portions of the table to establish a slot which extends around playing field board into which misdirected play pieces may drop. The playing field board has end zones at which play pieces may come to rest. The board is the top member of an air plenum chamber and is penetrated by an array of spaced apart airflow apertures situated at the end zones and extending therebetween. At least one motor driven air blower has an airflow outlet communicated with the plenum chamber.

In still another aspect the invention provides gaming apparatus having an elongated playing field board with a horizontal upper surface along which a player propels a play piece towards an end zone at which the play piece may come to rest. The end zone has at least one visible demarcation dividing the zone into areas of different score value. At least a portion of the playing field board which is at the end zone is formed of transparent material and the visible demarcation is a changeable image generated by an electronic display screen situated at the end zone.

In one aspect the invention enhances shuffleboard games in several respects by levitating play pieces on an outflow of air through an array of apertures in the playing field surface. The play pieces may be relatively light in weight and travel in a substantially friction free manner while in the levitated condition. Playing of shuffleboard is affected in a way which many players find to be exhilarating. The playing field may be of minimal length where that is desirable while remaining challenging to skillful players. Wearing of the playing field surface is greatly reduced. Playing of commercial shuffleboard games without payment can be prevented by shutting off the airflow when a player reaches a winning score or after elapse of a maximum playing time period without regard to the players' scores. In another aspect the invention further enhances shuffleboard gaming apparatus by providing a playing field formed at least in part of light transmissive material. This enables an advantageous illumination of the playing field from underneath. Scoreboard displays and other graphics may be viewed through the playing field itself. In preferred forms of the invention demarcations which divide scoring areas of different score value are changeable images produced by electronic display screens situated at the scoring zones. This enables player selection of any a plurality of different scoring zone demarcation patterns.

BRIEF DESCRIPTION OF THE DRAWINGS

FIG. 5 is a cross section view of the apparatus of FIG. 1 taken along line 5—5 thereof.

FIG. 6 is a top view of components of the apparatus that are shown in FIG. 5.

DETAILED DESCRIPTION OF THE PREFERRED EMBODIMENTS

Figure 1:
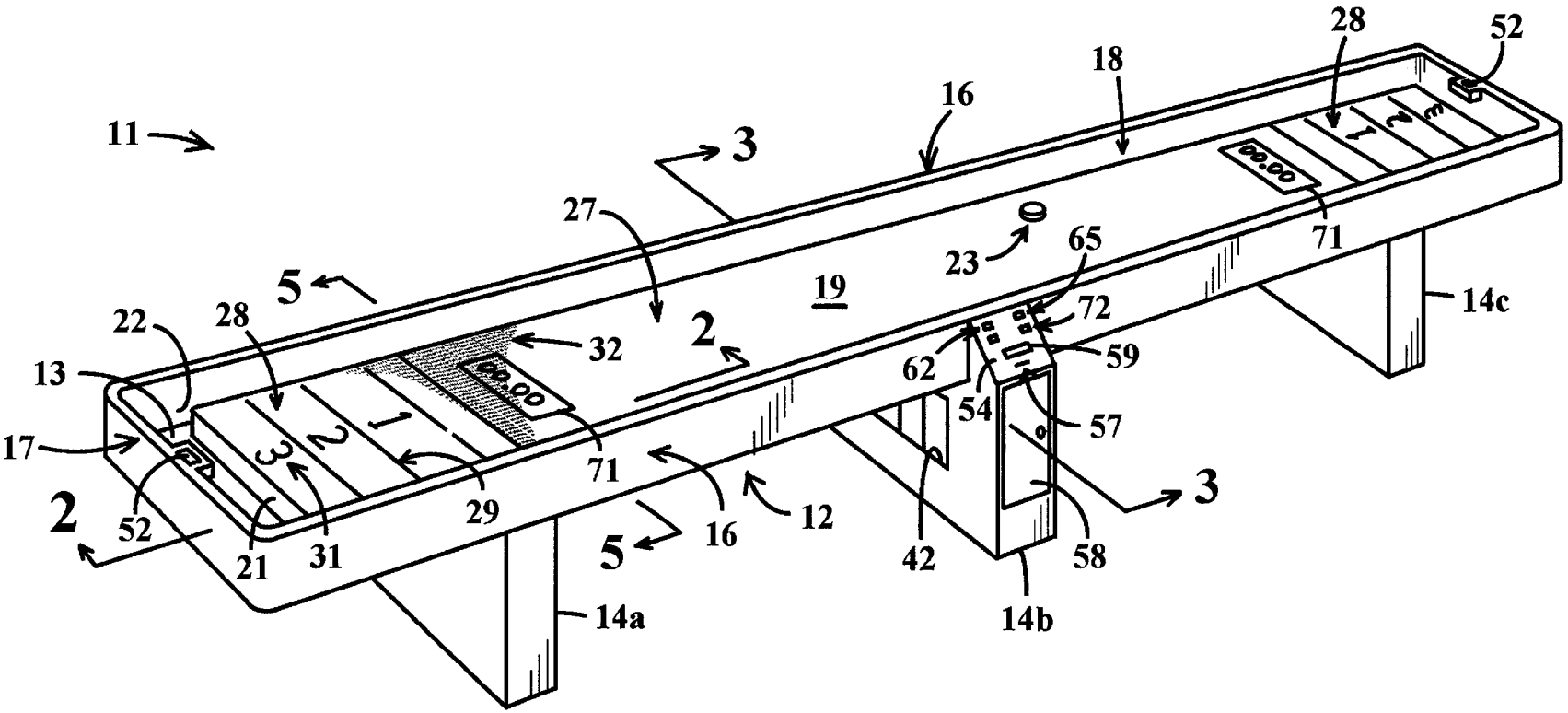
FIG. 1 is a perspective view of gaming apparatus of the shuffleboard table type which embodies the invention.
Figure 2:
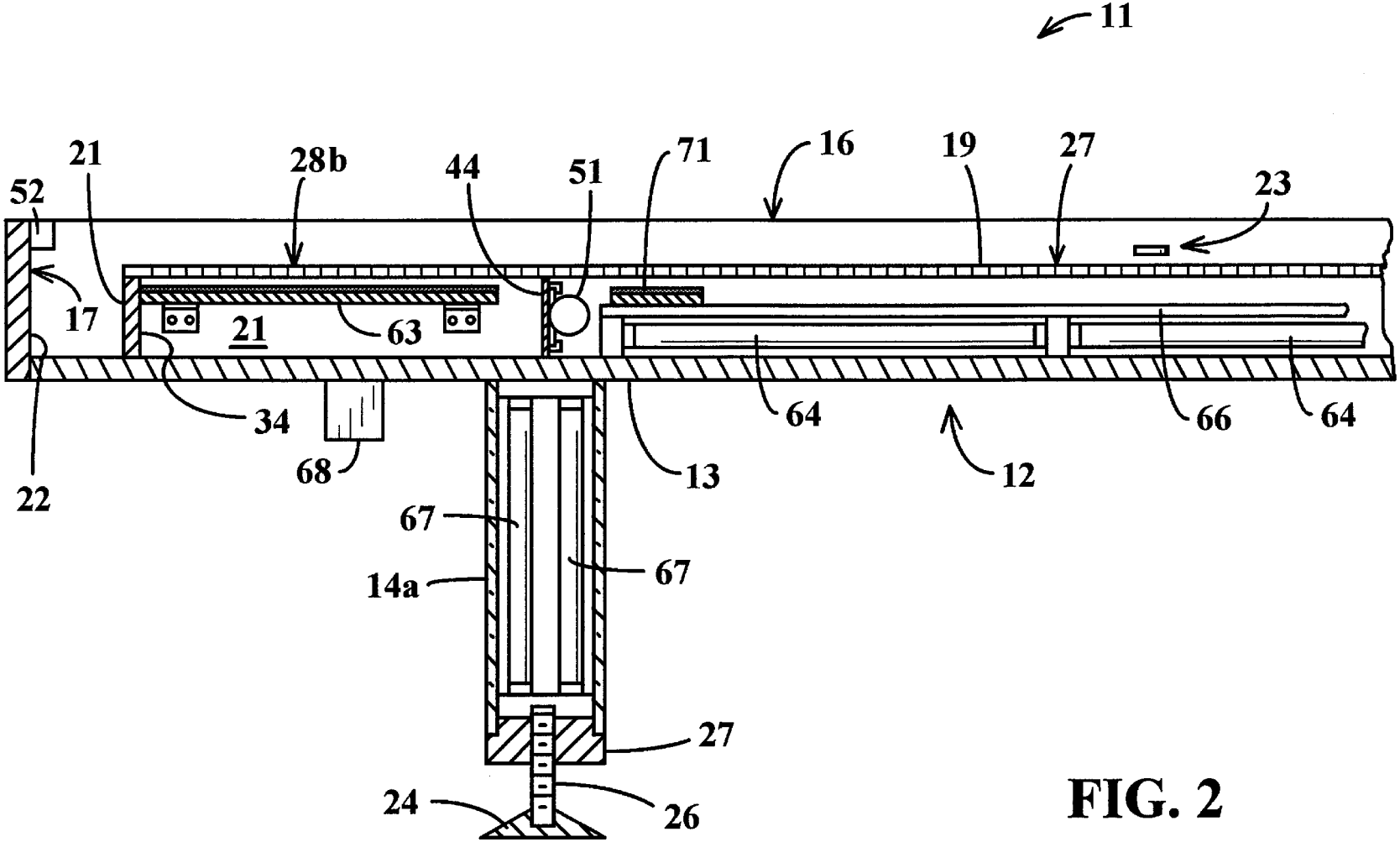
FIG. 2 is an elevation section view of a portion of the gaming apparatus of FIG. 1 taken along line 2—2 thereof.

Referring initially to FIGS. 1 and 2 of the drawings, the gaming apparatus 11 which is depicted for purpose of example is a shuffleboard table particularly suited for use in commercial game arcades where players pay for each period of use. Aspects of the invention are also adaptable to shuffleboard installations that do not require payment.

The gaming apparatus 11 of this example includes an elongated table 12 having a horizontal flat platform 13 supported by leg structures 14*a*, 14*b* and 14*c* which extend transversely under the platform. Platform 13 is bounded by side portions 16 and end portions 17 of the table 12 which extend along the edges of the platform and which extend upward from the edges of the platform. The side portions 16 and end portions 17 extend around a playing field region 18 in which an elongated flat playing field board 19 is situated. Board support members 21 extend along the edges of the board 19 and extend down to platform 13 and are proportioned to position the board at an elevation which is above that of that of the platform and below the tops of the side portions 16 and end portions 17 of the table 12. The playing field board 19 is narrower than the spacing of side portions 16 from each other and shorter than the spacing of end portions 17 from each other by amounts sufficient to create a slot 22 around the periphery of the board into which misdirected playing pieces 23 may fall from the board. The playing field board 19 in this particular example measures 10 feet long and 21 inches wide, other dimensions also being suitable.

Figure 3:
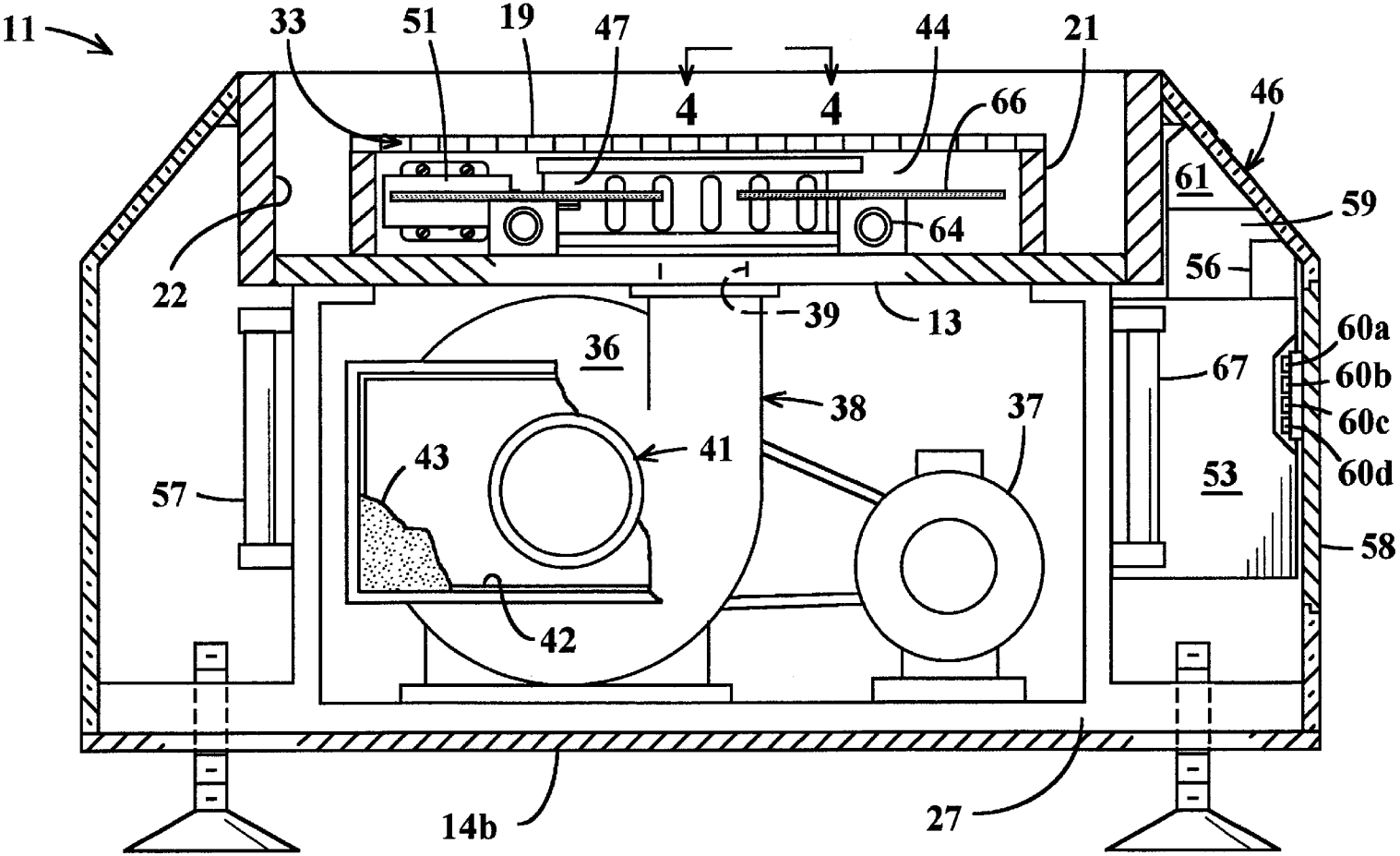
FIG. 3 is a cross section view of the gaming apparatus of FIG. 1 taken along line 3—3 thereof.

This particular example of the invention has three leg structures 14*a*, 14*b* and 14*c* which are rectangular housings containing additional components of the apparatus which will be hereinafter described. Leg structures 14*a*, and 14*c* are situated inward from the ends of the table 12 by a distance sufficient to avoid interference with the players legs. Center leg structure 14*b* is at the middle of the table 12 and preferably extends a small distance outward from the other components of the table 12 at each side of the table. As best seen in FIGS. 2 and 3, each of the leg structures 14*a*, 14*b* and 14*c* rests on a pair of pads 24 which are at the base of threaded stems 26 that engage in threaded bores in framing members 27 of the leg structures. Thus the playing field board 19 may be leveled by rotating the stems 26 as might be necessary to accommodate to an irregular or sloping floor.

Referring again to FIG. 1, the playing field board 19 has a play piece travel zone 27 which extends between first and second end zones 28*a*, 28*b* which are situated at opposite ends of the board. In this preferred embodiment the two end zones 28*a* and 28*b* alternately function as scoring zones in a manner which will be further described. Visible demarcations 29 divide the end zones 28*a* and 28*b* into areas of different score value and numerals 31 are displayed at the end zones 28*a* and 28*b* to indicate the score value of each such area. Playing of the game may, if desired, follow conventional procedure. Each player uses a plurality of play pieces 23, such as four play pieces for example, with each player's play pieces being differently colored or otherwise marked. Players are initially located at a first end of the table 12 and manually propel their play pieces 23 towards the end zone 28*a* or 28*b* at the opposite end of the table. The player endeavors deavors to have the piece 23 come to rest at the opposite end zone and preferably at the area of highest score value within the end zone. Players may aim their play pieces 23 towards an opponents play piece in an effort to dislodge the opponents play piece from a scoring location. When all play pieces 23 have been traveled along the playing field, the players move to the other end of the table 12, count their scores and resume playing by propelling their pieces back towards the end zone 28*a* or 28*b* at the first end of the table. In the typical form of play the game ends when a player achieves a predetermined particular winning score such as 21 for example. In this commercial example of the apparatus, the game also ends without regard to the players' scores after elapse of a maximum allowed period of playing time. Variations of the above described playing procedure are possible.

In this example, play pieces 23 are grasped in the player's hand and propelled along the playing field by hand and arm movement. It is also possible to use cue sticks to propel the play pieces.

The shuffleboard table 12 differs from prior constructions in that play pieces 23 are lifted out of contact with the playing field board 19, by an outflow of air from the board surface, as they travel towards an end zone 28*a* or 28*b*. This imparts a distinctly different ambiance to the game. Frictional resistance to motion of the play pieces is substantially eliminated when they are out of contact with the board 19. The play pieces may be lighter than conventional play pieces and less force is needed to propel the play pieces. In order to levitate the play pieces 23 in this manner, the board 19 is penetrated by an array 32 of airflow apertures 33.

Preferably the airflow aperture array 32 extends for substantially the entire length of the board 19 including along the end zones 28*a* and 28*b* and along the portion of the board which extends therebetween. Air outflow is suppressed temporarily at the end zone 28*a* or 28*b* towards which the play pieces 23 are being propelled at any given time. This enables frictional slowing of the play pieces 23 at the targeted end zone 28*a* or 28*b* so that they may come to rest at that end zone.

Figure 4:
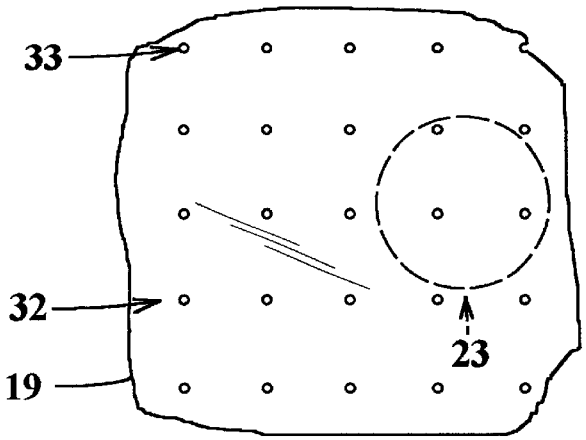
FIG. 4 is a top view of a portion of the playing field of the gaming apparatus taken along line 4—4 of FIG. 3.

Referring to FIG. 4, the apertures 33 of array 32 are spaced apart by a distance which is less than the diameter of the play pieces 23 by an amount sufficient to cause the underside of the play piece 23 to be impacted by more than one upflowing air jet at any given time. This assures that the play piece is lifted from the surface of the playing field board 19 sufficiently to substantially avoid frictional resistance to travel of the piece. In the present example the play pieces 23 have a diameter of two inches and the airflow apertures 33 are spaced one inch apart and have a diameter of 0.04 inch, other dimensioning also being workable.

Referring to FIGS. 2 and 3, playing field board 19 forms the top wall of an air plenum chamber 34 which is otherwise bounded by the board support members 21 and platform 13. The upward airflow through apertures 33 is created by an air blower 36 situated in the middle leg structure 14*b* below platform 13 and which is driven by an electrical drive motor 37 also situated in the leg structure. Air blower 36 has an airflow outlet tubulation 38 which extends upward to a plenum chamber inlet opening 39 in platform 13. The air inlet tubulation 41 of the blower 36 draws in air through an opening 42 in the wall of leg structure 14*b* which opening is visible in FIG. 1. Referring again to FIG. 3, a replaceable air filter 43 extends across opening 42.

Referring to FIGS. 2 and 3, the air plenum chamber 34 is divided into three subchambers by a pair of spaced apart partitions 44 which extend transversely in the chamber. The partitions 44 are positioned to enable selective blockage of airflow from either of the end regions of the chamber 34 that are under the end zones 28*a* and 28*b* of the playing field board 19. Referring jointly to FIGS. 5 and 6, each partition 44 has a series of spaced apart openings 46. A slidable gate member 47 is disposed against the partition 44 and has a similar series of openings 48. The gate member 47 is held in place by rails 49 and is slidable along the rails between a first position at which the partition openings 46 are blocked by the gate member 47 and a second position at which the gate member openings 48 are in register with the partition openings 46. Thus airflow into each end region of plenum chamber 34 is blocked when the gate member 47 at that end region is at its first position and is enabled when the gate member is at its second position. An extendible and contractible actuator 51 is secured to the partition 44 and coupled to the gate member 47 to slide the gate member between its two positions. The actuators 51 of this example are of the electrical solenoid type which are spring biased to the extended position and which contract in response to electrical energization although other types of actuator may also be used.

Referring jointly to FIGS. 2 and 3 the two actuators 51 are energized alternately in response to actuation of electrical switches by a player, an electrical circuit for the purpose being hereinafter described. Referring to FIG. 1, play direction selector switches 52 for this purpose are situated at each end of the playing table 12 and are preferably of the type which contain a lamp that may be turned on and off to indicate the current direction of play as will hereinafter be further described. Players initially station themselves at the end zone 28*a* or 28*b* of the table 12 at which an air outflow is occurring at that time and propel their playing pieces 23 towards the opposite end zone where there is no air outflow at that time. After all playing pieces are at the opposite end zone 28*a* or 28*b* a player operates a direction selector switch 52 to reverse the direction of play. Operation of the direction switch at this time enables a resumption of play by causing an outflow of air at the end zone 28*a* or 28*b* where there previously was none and by suppressing air outflow at the end zone where it was previously occurring.

Thus the gate members 47 and actuators 51 function as means for selectively stopping airflow emission at either of the first and second end zones 28*a* and 28*b* while enabling airflow emission at the other thereof. Such means may take other forms. For example, the air plenum chamber partitions 44 may have no openings 46 and gate members 47 and actuators 51 are not needed if a separate one of three air blowers provides airflow to each of the three subchambers of the air plenum chamber 34.

Referring jointly to FIGS. 1 and 3, this commercial version of the gaming apparatus 11 includes a coin verifier and collector 53 which may be of the known construction that is present in many forms of commercial gaming apparatus. Coin verifier and collector 53 is situated within the middle leg structure 14*b* below a control panel 54 portion of the leg structure which slopes downward and outward from side of the table. A chute 56 delivers coins, which are entered in a coin receiver slot 57 in panel 54, to the coin verifier and collector 53. A lockable door 58 in the leg structure 14*b* provides for access to the coin verifier and collector 53. The coin verifier may supplemented by or replaced with a paper currency verifier 59 and/or a credit card validator which components may be of the known form.

It is advantageous if the owner of the gaming apparatus 11 can selectively change certain operating parameters such as the amount of payment which is required to play the game and the maximum playing time which is allowed without regard to a player' score, for example. Four programming switches 60 are provided for this purpose and are used in a manner which will hereinafter be described.

The programming switches 60 should be at a location which is inaccessible to players and in this example are attached to the inside of the lockable door 58.

A circuit housing 61, situated within the middle leg structure 14*b* immediately behind control panel 54 in this example, contains electrical components which will hereinafter be described. These include a game selector switch 62 and game start 65 which protrude through the control panel. The start switch 65 is preferably of the type which contains a lamp that can be turned on at certain times as will hereinafter be described. Successive operations of the game selector switch 65 condition the system to display successive ones of a series of different graphics for different games as will hereinafter be further described. The electrical components may be situated at other locations if desired.

Referring to FIGS. 1 and 2, the playing field board 19 may be formed of opaque material but is preferably a light transmissive material as this provides for a number of advantageous effects such as illumination of the playing field from underneath, for example. The term light transmissive as used herein and in the appended claims should be understood to refer to either translucent material or transparent material. The playing field board 19 of this particular example is transparent to enable viewing of electronic display screens 63 through the board as will hereinafter be further described.

Referring to FIGS. 2 and 3, illumination of the playing field board from below in this embodiment of the invention is provided by fluorescent light fixtures 64 within the plenum chamber 34 which extend along the upper surface of platform 13. Panels 66 of light diffusing material situated above the light fixtures 64 provide for a more uniform illumination of the playing field board.

The ability of the shuffleboard table to attract the interest of potential players can be further enhanced by additional lighting effects. For this purpose, the walls of the leg structures 14*a*, 14*b* and 14*c* are formed of translucent plastic or other light transmissive material. Additional lighting fixtures 67 are situated within the leg structures 14*a*, 14*b* and 14*c* in position to illuminate the walls. Preferably the lighting fixtures 67 strobe on and off synchronously or sequentially. Sound effects can also attract players and add interest to the game. For this purpose one or more audio speakers 68 may be provided at the table 12. A speaker 68 is situated at the underside of platform 13 near each end of the table 12 in this example as depicted in FIG. 2. The speakers may be at other locations in, on or around the table if desired.

Referring to FIGS. 1 and 2, the demarcations 29 which divide areas of different score value at scoring zones 28*a*, 28*b* and the numerals 31 which indicate score value can be permanently imprinted on the playing field board 19 but preferably are changeable images produced by electronic image display screens 63 situated immediately below the board at the scoring zones. This adds much interest to the gaming apparatus as the pattern of demarcation and/or score values can be changed to provide variations of the game which may be selected by the players. The display screens 63 may be of any of a variety of known types that can display instantly changeable images such as arrays of light emitting diodes which can be individually energized to produce different light patterns. Preferably, as in this particular example, the display screens 63 are flat panel displays of the type widely used as monitors in laptop or notebook computers or as screens for thin television receivers. Screens 63 of this type generate an array of minute image pixels which can be switched on and off individually to create images of any desired configuration.

Figure 7:
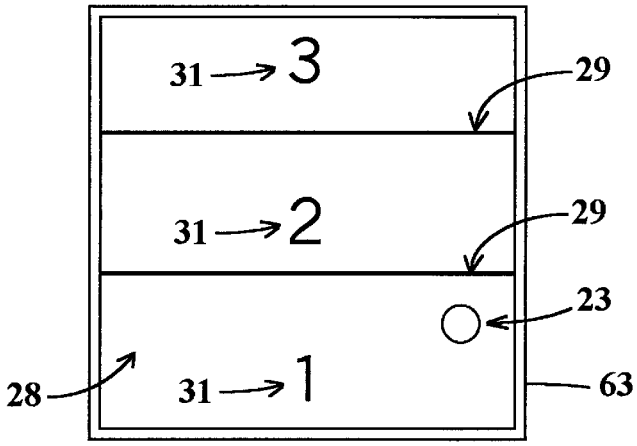
FIG. 7 is a top view of an electronic display screen which displays scoring zone demarcations and score values in the apparatus of the preceding figures.
Figure 8:
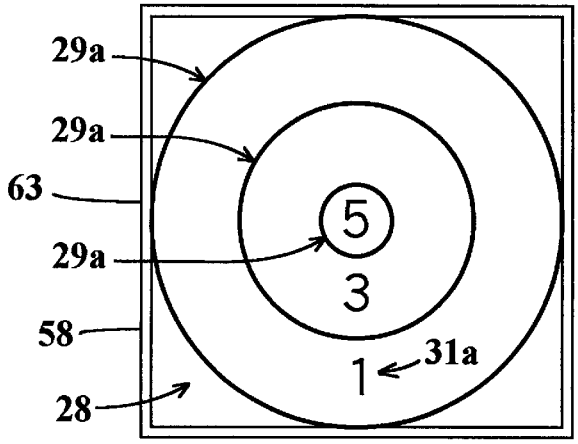
FIG. 8 is a top view of the electronic display screen of FIG. 7 shown displaying a different pattern of scoring zone demarcations.
Figure 9:
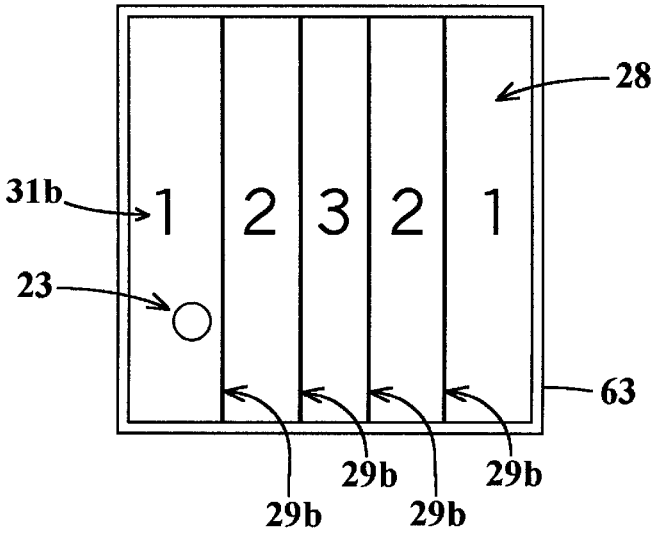
FIG. 9 is another top view of the electronic display screen of FIG. 7 shown displaying still another pattern of scoring zone demarcations.

The screens 63 can for example be conditioned to display a shuffleboard demarcation pattern, depicted in FIG. 7, in which demarcation lines 29 divide the scoring zones 28 into three parallel bands oriented at right angles to the path of travel of the play pieces 23 with the bands being of progressively higher score value and of progressively diminishing size. The screens also display numerals 31 indicative of the score value of each band. FIG. 8 depicts a first alternate demarcation pattern which can be displayed, termed "Bullseye", in which three concentric circles 29*a* of progressively greater diameter appear at each scoring zone 28 thereby defining a center circle of highest score value which is encircled by two circular bands of progressively greater diameter and progressively diminishing score value. FIG. 9 depicts still another variation of the demarcations , creating a game termed "Sliders", in which the screens 63 display parallel spaced apart lines 29*b* that divide the scoring zones 28 into parallel bands that extend in the direction of travel of the play pieces 23. Displayed numerals 31*b* designate a highest score value for the center band and progressively lower score values for the bands on each side of the center band.

The scoring zone demarcation patterns shown in FIGS. 7, 8 and 9 are only examples as the screens 63 can be conditioned to display diverse other demarcation patterns and score values.

Scoring zone demarcation patterns are shown at both ends of the playing field in FIG. 1 in order to facilitate an understanding of the invention. In the preferred form of the invention the scoring zone demarcation pattern is displayed at only one end of the playing field zone at any given time and appears alternately at opposite ends of the playing field as will hereinafter be described.

Referring again to FIGS. 1 and 2, a playing field board 19 which is transparent or which has transparent areas enables presentation of still other changeable information at the board itself. For example, shuffleboard games are often provided with scoreboard displays 71 which display the current scores of each players. The players enter their scores by operating switch buttons 72. Traditionally such scoreboard displays have been mounted on posts which extend upward from a side of the shuffleboard table. In this embodiment the scoreboard displays 71 are situated below the playing field board 19 in position to be visible through the board. There are preferably two such scoreboards 71 each being located near an opposite end of the board 19 so that scores are readily visible to players at either end of the shuffleboard table 12. Except for being located underneath the playing field board 19, the scoreboard displays 71 may be of the known form.

Electronic display screens may be used to make other changeable graphics visible at the playing field board 19 such as advertising messages or images which are simply for entertainment purposes or to add interest to the game.

Figure 10:
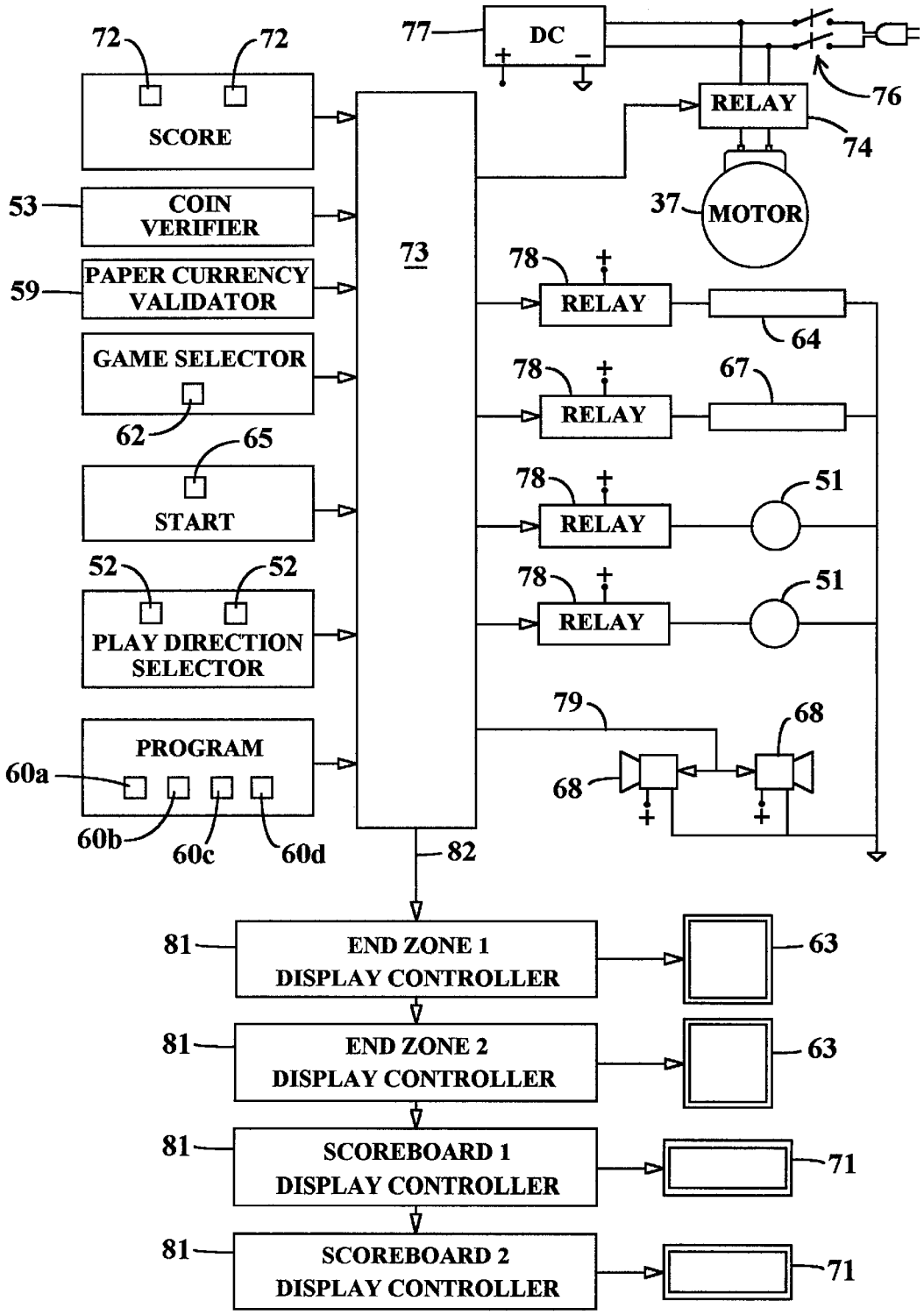
FIG. 10 is a schematic circuit diagram depicting electrical components of the apparatus of the preceding figures and interconnections therebetween.

Referring to FIG. 10, the above described electrical components, such as blower motor 37, playing field lights 64, attraction lights 67, blower gate operating solenoids 51 and audio speakers 68, are activated and deactivated at various stages during the cycle of operation. This can be accomplished by a combination of discrete timers, count registers, control switches and the like but preferably the control functions are performed by a digital data processor 73 which in this particular example is an 803C1 microcontroller of the known type.

Data processor 73 activates and deactivates the blower motor 37 by controlling a first relay 74 which supplies AC utility power to the motor through a system on-off switch 76. A DC power supply 77, which is a 12 volt supply in this particular example, provides operating power for other components of the system including playing field lights 64, attraction lights 67, blower gate operating solenoids 51 and audio speakers 68. Four additional relays 78 enable the playing field lights 64, attraction lights 67 and blower gate operating solenoids 51 to be turned on and off by the data processor 73. A signal channel 79 enables data processor control of sounds produced by the audio speakers 68. The two end zone display screens 63 and the two scoreboard display screens 71 each have a display screen controller 81 of one of the known forms which enables display of changeable images at the controlled display screen. Each such display screen controller 81 is itself controlled by the data processor 73 through a connection 82 to the serial port of the data processor.

The previously described coin verifier 53 and paper currency validator 59 provide count signals to processor 73 which enables the processor to store a monetary credit value indicative of unused payment by players. The processor 73 also receives signals in response to successive actuations of the game selector switch 62 and signals indicative of actuations of the start switch 65. Actuation of either of the end zone selector switches 52 sends a signal to processor 73 to enable reversal of the direction of play at the table. The processor 73 also receives signals indicative of actuations of the player's score count switches 72, to enable updating of the scoreboard displays 71, and signals indicative of actuations of the programming switches 60*a*, 60*b*, 60*c* and 60*d*.

In the flowchart program which will now be described, programming switch 60*a* is termed the Program Mode Switch, switch 60*b* is termed the Increment Parameter Switch, switch 60*c* is termed the Increment Data Switch and switch 60*d* is termed the Decrement Data Switch. Referring to FIG. 1, end zone 28*a* of the playing field is designated as END 2 for purposes of the flowchart and the play direction in which players propel pieces towards that end zone is designated as DIRECTION 2. Referring jointly to FIGS. 1 and 3, the solenoid of the actuator 51 that is closest to end zone 28*a* is designated SOLENOID 2 for purposes of the flowchart. The play direction selector switch 52 at that end zone is designated DIRECTION SWITCH 1. End zone 28*b* is designated END 1, play in the direction of that end zone is designated DIRECTION 1, the solenoid of the actuator 51 that is closest to end zone 28*b* is designated SOLENOID 1 and the play direction selector switch 52 which is at end zone 28*b* is designated DIRECTION SWITCH 2.

Figure 11A:
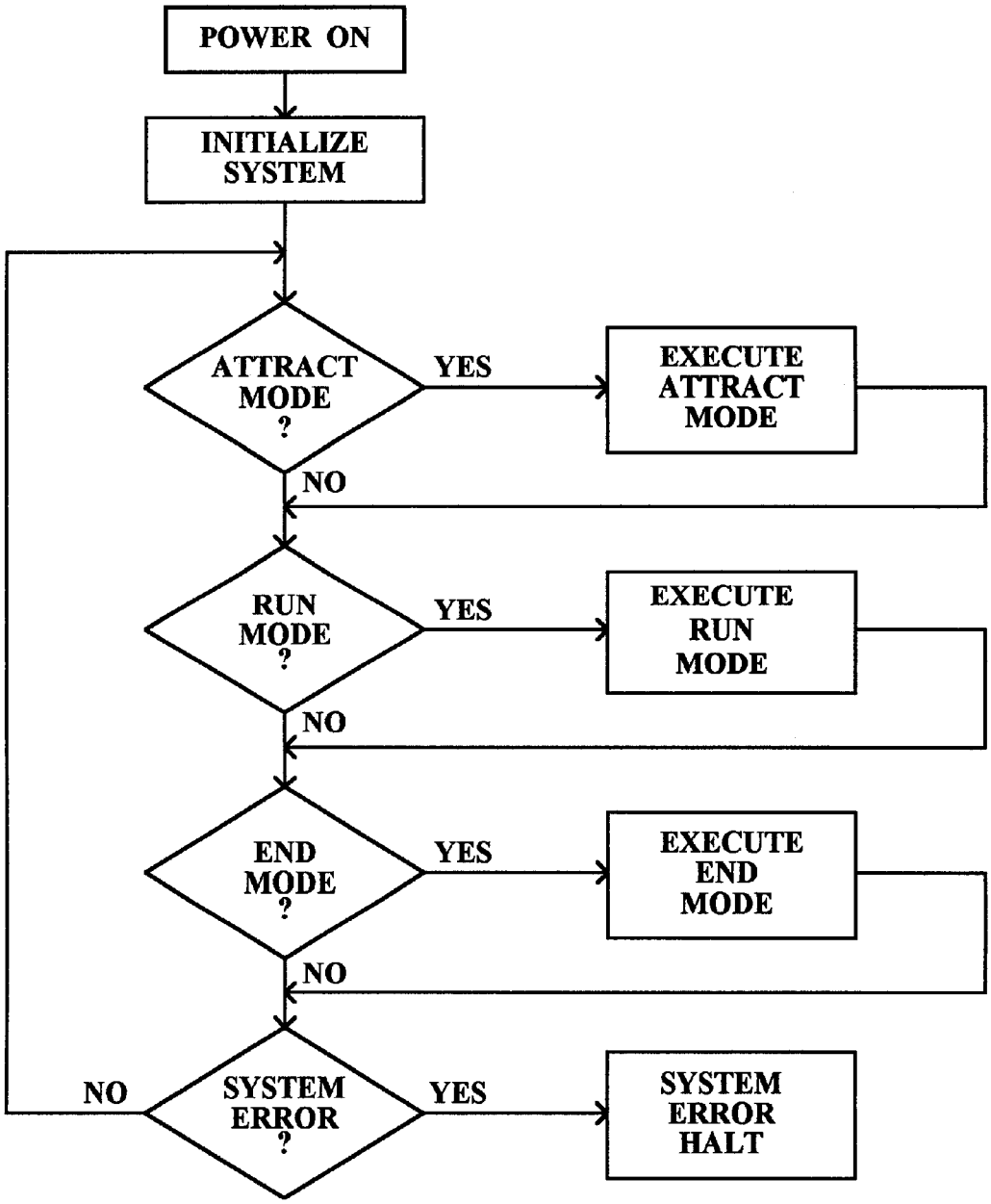
FIGS. 11A to 11I depict, in flow chart form, suitable programming for a digital data processor component of the circuit of FIG. 10.

Suitable programming for the digital data processor 73 to effect operation of the shuffleboard table is depicted in flowchart form in FIGS. 11A to 11I. FIG. 11A in particular depicts the main program loop. As shown in FIG. 11A, the main program loop includes three modes of operation which are termed the ATTRACT mode, the RUN mode and the END mode each of which will hereinafter be described in more detail. The ATTRACT mode creates conditions, such as flashing lights, display screen displays and audio effects, that are designed to attract the attention of potential players in the vicinity. The RUN mode enables playing of a game in the previously described manner. The END mode terminates playing of a game and returns the system to the ATTRACT mode provided that no system error is detected at that time.

Figure 11B:
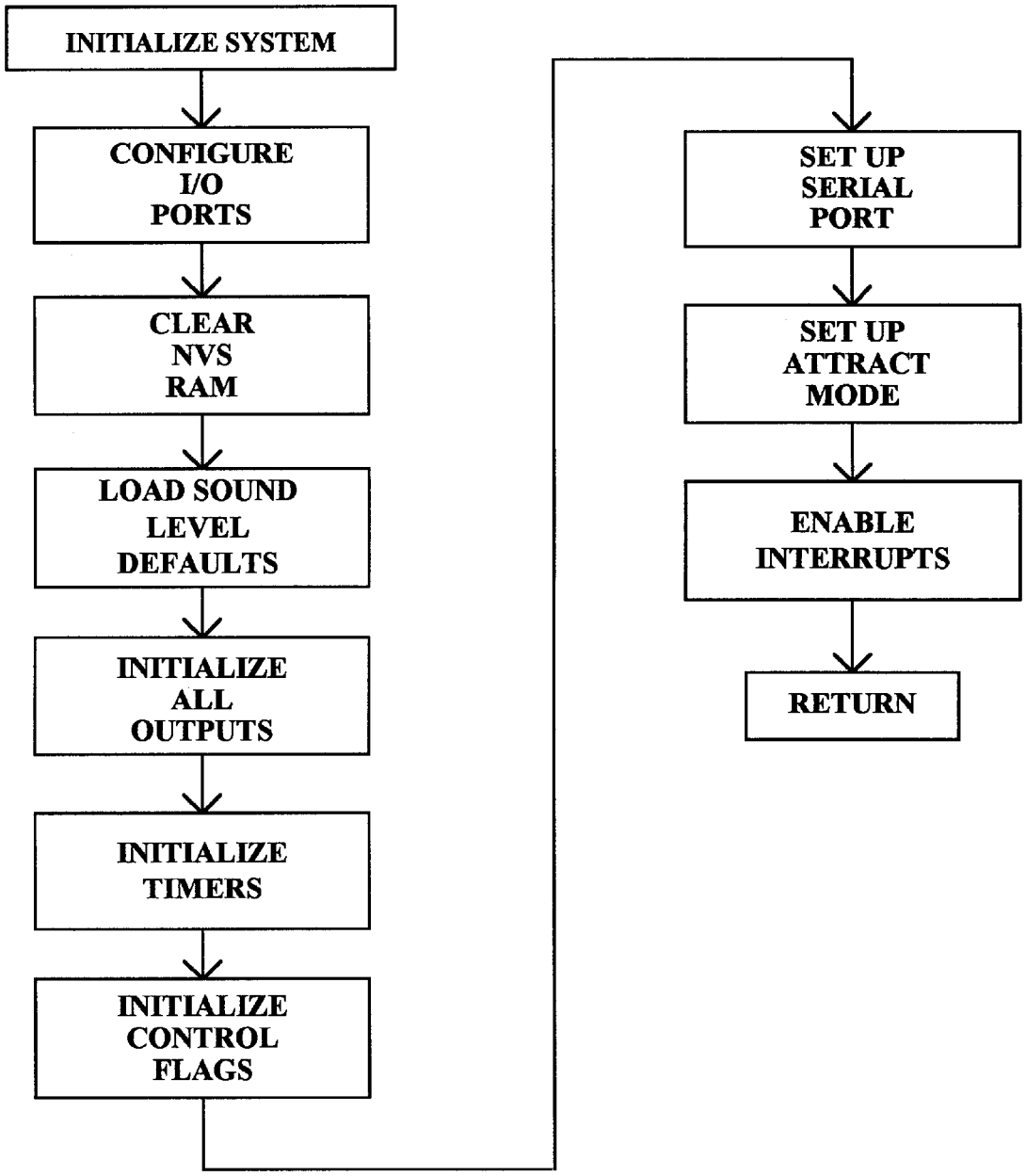

Following power on by closure of the gaming apparatus on-off switch, the program initializes the system. As shown in FIG. 11B the initializing process includes the steps of configuring the processor input/output ports, clearing non-volatile storage and random access memory, loading sound level defaults, initializing outputs and timers and control flags, setting up the serial port, setting up the ATTRACT mode and enabling interrupts.

Following the initialization, with reference again to FIG. 11A, the program checks to see if the ATTRACT mode is currently set up and if that is the case then proceeds to execute that mode until the mode is exited by events which will hereinafter be described. Upon exiting the ATTRACT mode or if that mode was found not to be set up during the previous check, the program checks to see if the RUN mode is currently initialized. If it is, the program proceeds to execute the RUN mode until it exited as a result of events to be hereinafter described. Upon exiting the RUN mode or if that mode was found not to be initialized during the previous check, the program checks to see if the END mode is currently enabled and proceeds to execute the END mode if that is the case. After exiting the END mode or if that mode was found not to be enabled during the previous check the program checks to see if any system error signal has been registered. If not, the program loops back and repeats the above described steps starting with checking to see if the ATTRACT mode is set up.

Figure 11C:
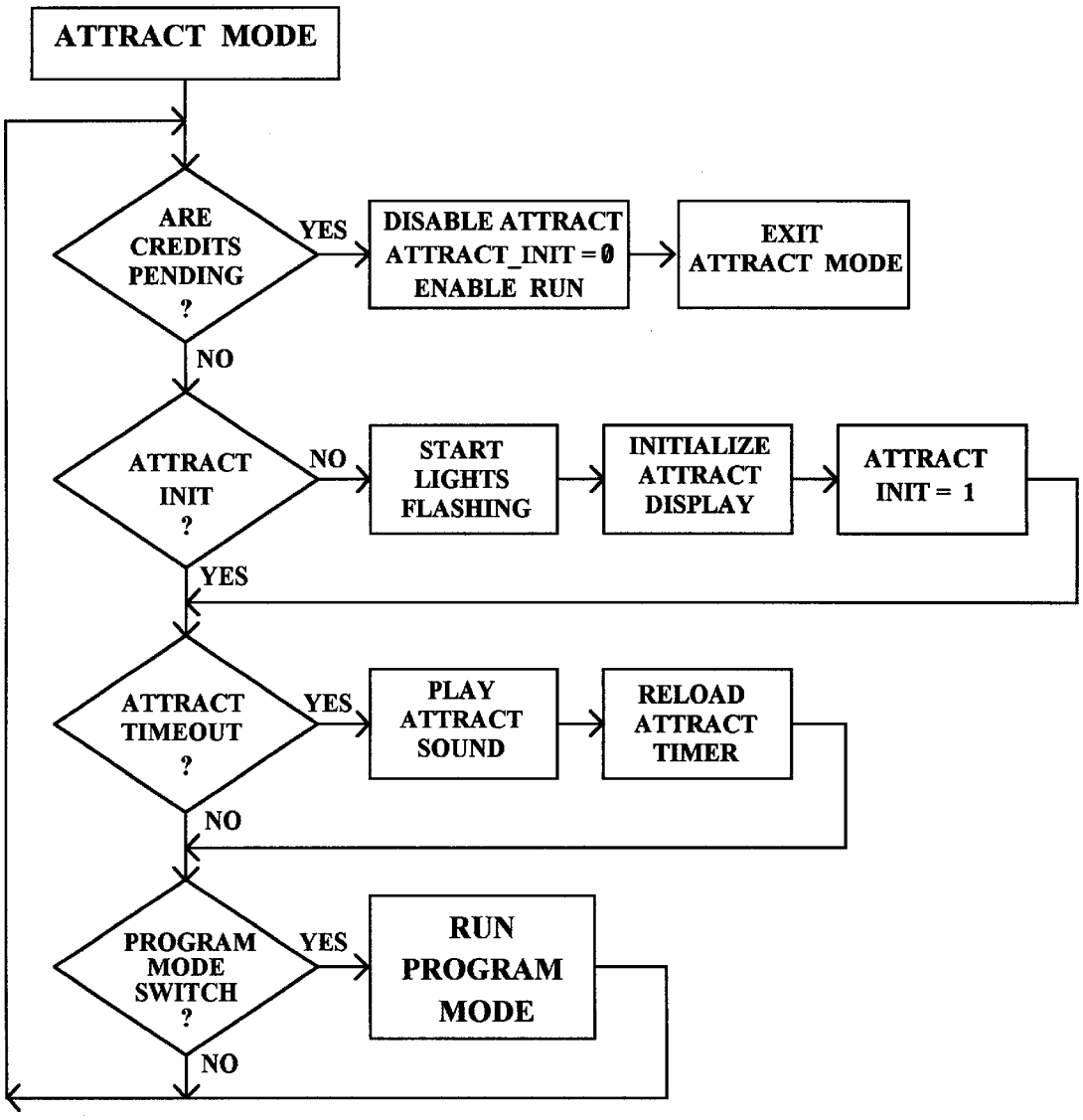

Referring to FIG. 11C, steps performed by the program during the ATTRACT mode include checking to see if there is monetary credit registered as a result of payment of coins or currency by a player. If there is monetary credit, the program disables the ATTRACT mode, enables the RUN mode and returns to the main program loop. If there is no monetary credit, the program checks to see if the ATTRACT mode is currently enabled and if it is not then proceeds to initiate that mode such as by causing the attract lights to flash and by conditioning the display screens to display graphics which attract attention. One of the internal timers of the data processor is herein termed the attract timer and enables a periodic playing of sound effects designed to attract attention. After enabling the ATTRACT mode or if it was found to be already enabled, the program determines if the attract timer has timed out. If it has, the program initiates playing of the sound effects and then reloads the attract timer to prepare for a subsequent cycle of sound. The program then checks to see if the previously described program mode switch has been operated. If it has, a program mode routine to be hereinafter described is initiated. If the switch has not been operated or upon completion of the program mode, the program loops back to the start of the ATTRACT mode and repeats the above described sequence of steps.

Figure 11D:
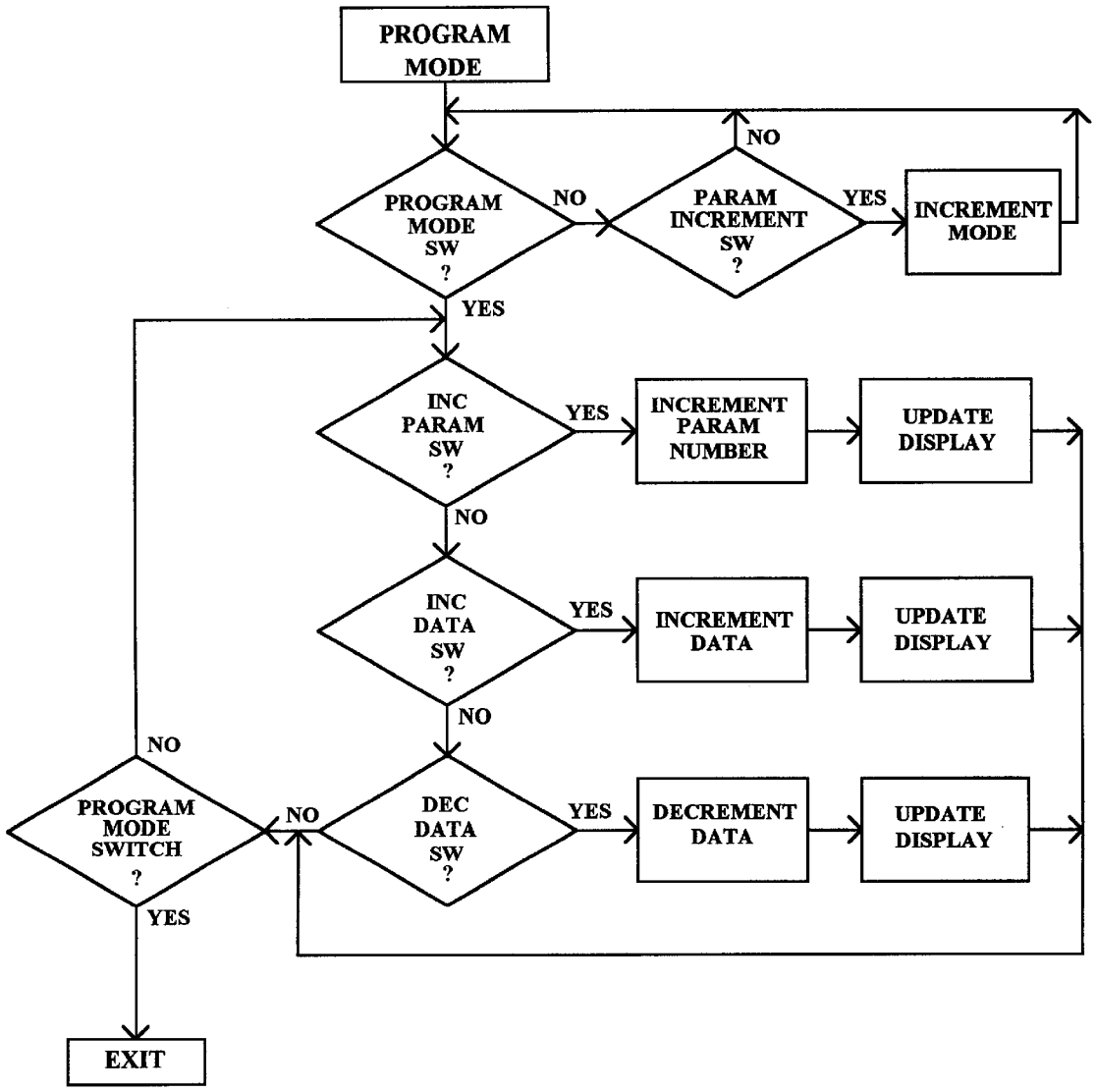

It is advantageous if the owner of the gaming apparatus can change certain operating parameters such as the cost of playing a game and the maximum time which is allowed for playing a game among other parameters. Referring to FIG. 11D, the PROGRAM mode of this example of the invention enables such parameter adjustments. Operator actuation of the previously described Program Mode Switch while the system is in the ATTRACT mode of operation initiates the PROGRAM mode. Sub modes of operation within the PROGRAM MODE enable operator adjustment of different parameters. The previously described Increment Parameter Switch enables operator selection of the particular parameter such as game cost or maximum playing time for example, which is to be changed. The previously described Increment Data Switch enables the operator to increase the numerical value of a selected parameter in steps. The Decrement Data Switch allows the operator to decrease the value of a selected parameter in steps. It is advantageous if the parameters which can be changed and their currently selected values are displayed at one or more of the previously described display screens such as at the score board displays for example.

As shown in FIG. 11D, the program implements these operations in the PROGRAM mode by first checking to see if a second actuation of the Program Mode Switch has occurred which condition would indicate that the operator desires to make a change in a parameter of the currently selected sub mode. If it has not occurred the program checks to see if the Increment Parameter Switch has been actuated. If it has, the program increments the sub mode selection and then loops back to again check for the second actuation of the Program Mode Switch. The program also loops back to check for the second actuation of the Program Mode Switch if the Increment parameter switch has not been actuated.

Detection of a second actuation of the Program Mode Switch indicates that the operator wishes to change a parameter of the currently selected sub mode of operation. The program responds to the second actuation of the Program Mode Switch by checking to see if the Increment Parameter Switch has been actuated which condition would indicate that the operator wishes to change a parameter other than the currently selected parameter of the sub mode. If the Increment Parameter Switch has not been actuated, the program checks to see if the Increment Data Switch has been actuated in which case the program increases the value of the currently selected parameter by one step and updates the display of the value. If the Increment Data Switch has not been actuated, the program checks to see if the Decrement Data Switch has been actuated in which case the program decreases the value of the currently selected parameter by one step and updates the display of the value. Following either an increasing or decreasing of the selected parameter value, the program checks to see if a third actuation of the Program Mode Switch has occurred. If it has not, the program loops back and repeats the above described steps which follow the second actuation of the Program Mode Switch to enable further stepped changes of parameter values. If the Program Mode Switch has been actuated for a third time, indicating that the operator has finished adjusting parameters or does not wish change parameter values, the program exits the PROGRAM mode and returns to the ATTRACT mode of the main program loop.

Detection of an actuation of the Increment Parameter Switch just prior to the above described checking of the Increment Data Switch indicates that the operator wishes to change a parameter other than the currently selected parameter. The program responds by selecting the next parameter in the sequence of parameters that can be changed in the currently selected sub mode of operation, updating the parameter number which is being displayed and than checking to see if another actuation of the Program Mode Switch has occurred. If it has not, the program loops back and checks to see if still another actuation of the Increment Parameter Switch has occurred. If it has not, the program returns to the sequence of steps which begins with checking to see if the Increment Data Switch has been operated.

Figure 11E:
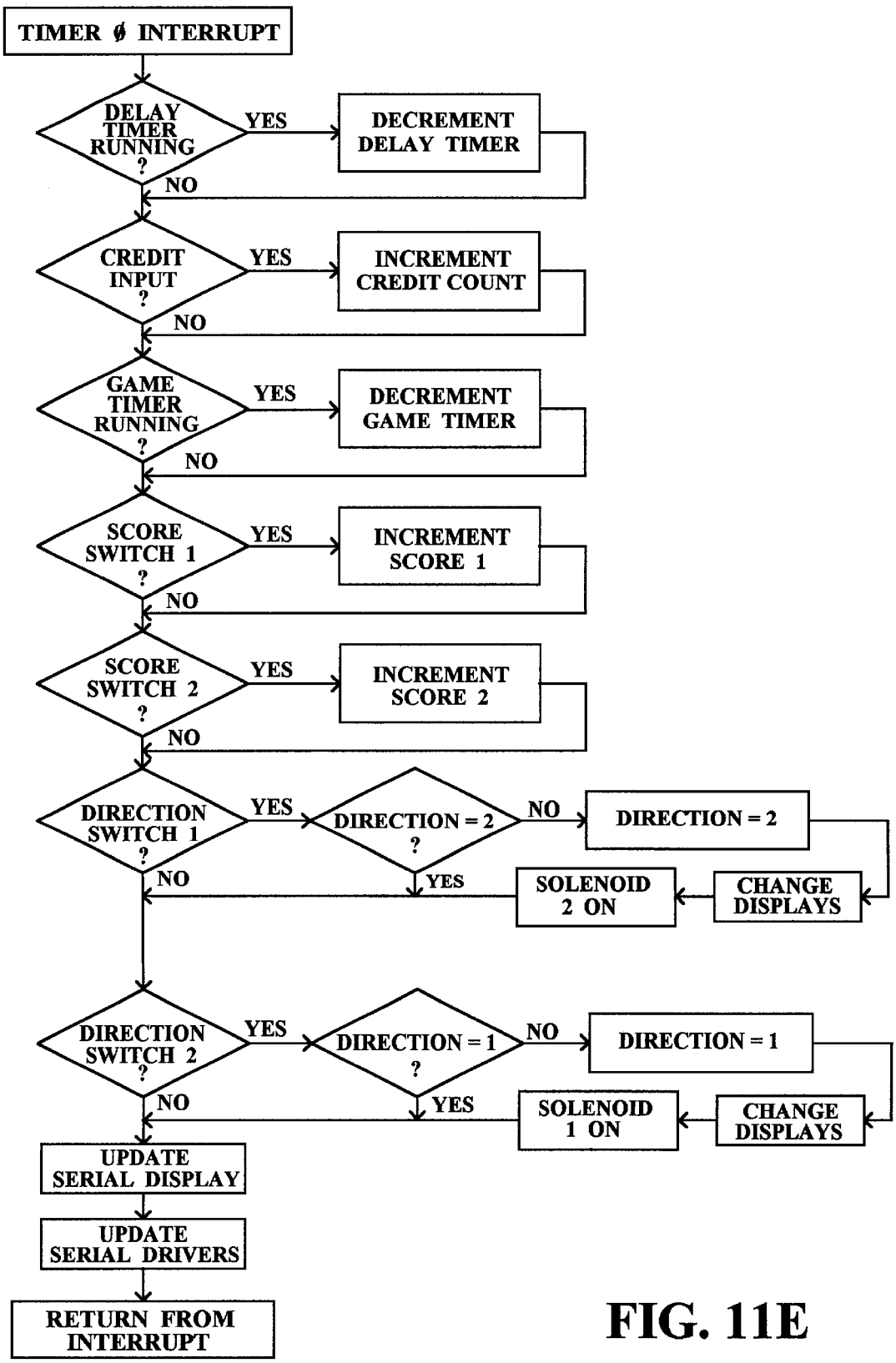

Referring to FIG. 11E, the program performs an interrupt routine at periodic intervals to detect changes in operating conditions. In this example the interrupt occurs every 10 milliseconds. Initially the interrupt program checks to see if a delay timer is running and decrements the timer by a unit amount if it is running, the timer being internally configured in the data processor and being hereinafter further discussed in connection with the END mode of operation. The interrupt program then proceeds to check to see if any new credit input has been registered. If it has the program increments the credit count. Following incrementing of the credit count or if no credit input has been detected the program checks to see if a game timer, internally configured within the data processor, is currently running. If it is, the program decrements the game timer. Following decrementing of the game timer or if the timer was found to be not running the program checks to see if the first player's score switch has been operated. If it has the program increments the first player's score. Following incrementing of the first player's score or if no operation of the first player's score switch was found the program checks to see if the second player's score switch has been operated. If it has the program increments the second player's score. Following incrementing of the second player's score or if no operation of the second player's score switch was found the program checks to see if Direction Switch 1 has been operated by a player in order to reverse the direction of play from play direction 1 to play direction 2. If the switch has been operated the program checks to see if the system is already conditioned for play direction 2. If it is not, the program establishes the play direction 2 mode of operation. The end zone display screens are conditioned to switch the scoring zone graphics from end zone 28*b* to end zone 28*a* and actuator solenoid 2 is turned on to block air outflow at end zone 28*a*. Following these steps or if the system was found to be already conditioned for play direction 2 the program checks to see if play direction switch 2 has been operated by a player. If the switch has been operated the program checks to see if the system is already conditioned for play direction 1. If it is not, the program establishes the play direction 1 mode of operation. The end zone display screens are conditioned to switch the scoring zone graphics from end zone 28*a* to end zone 28*b* and actuator solenoid 1 is turned on to block air outflow at end zone 28*b*. Following these steps or if the system was found to be already conditioned for play direction 1 or if no operation of direction switch 2 was detected the program updates the serial display screen content, updates the serial drivers and returns to the main program loop of FIG. 11A.

Figure 11F:
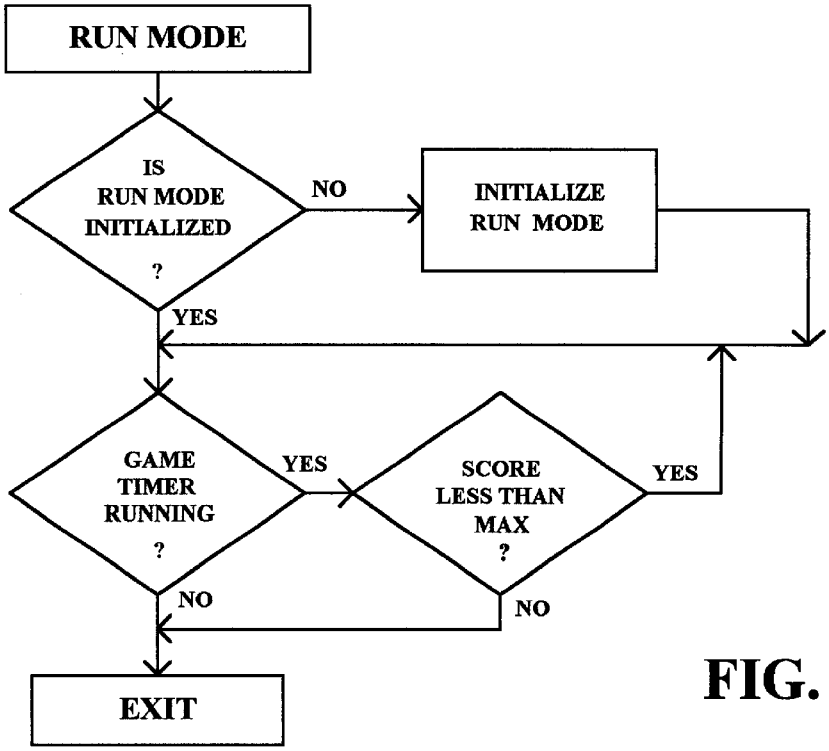

Referring to FIG. 11F, upon entering the RUN mode, the program checks to see if the RUN mode has been initialized and proceeds with the initialization if that is not the case. Following the initializing or if the RUN mode is already initialized the program checks to see if the game timer is running. If it is, the program checks to see if each player's score is less than the maximum. If the game timer is running and no player has reached the maximum score, the program loops back and again checks the game timer and player scores. When the game timer times out or if a player has reached a maximum score the program exits the RUN mode.

Figure 11I:
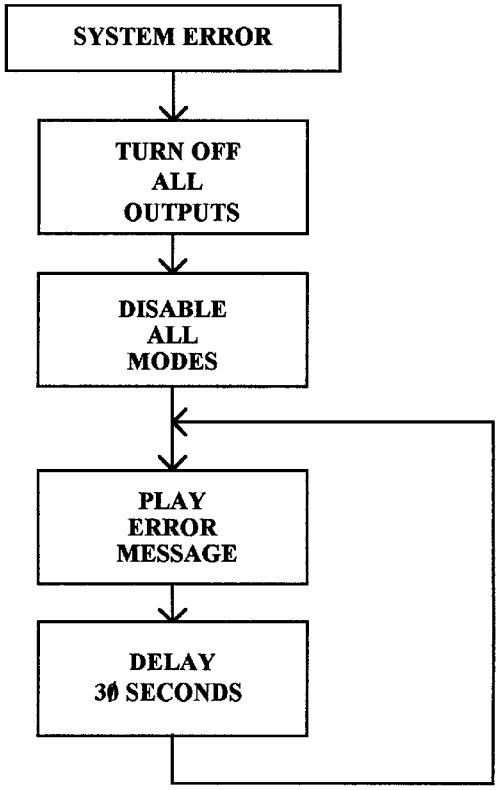
Figure 11G:
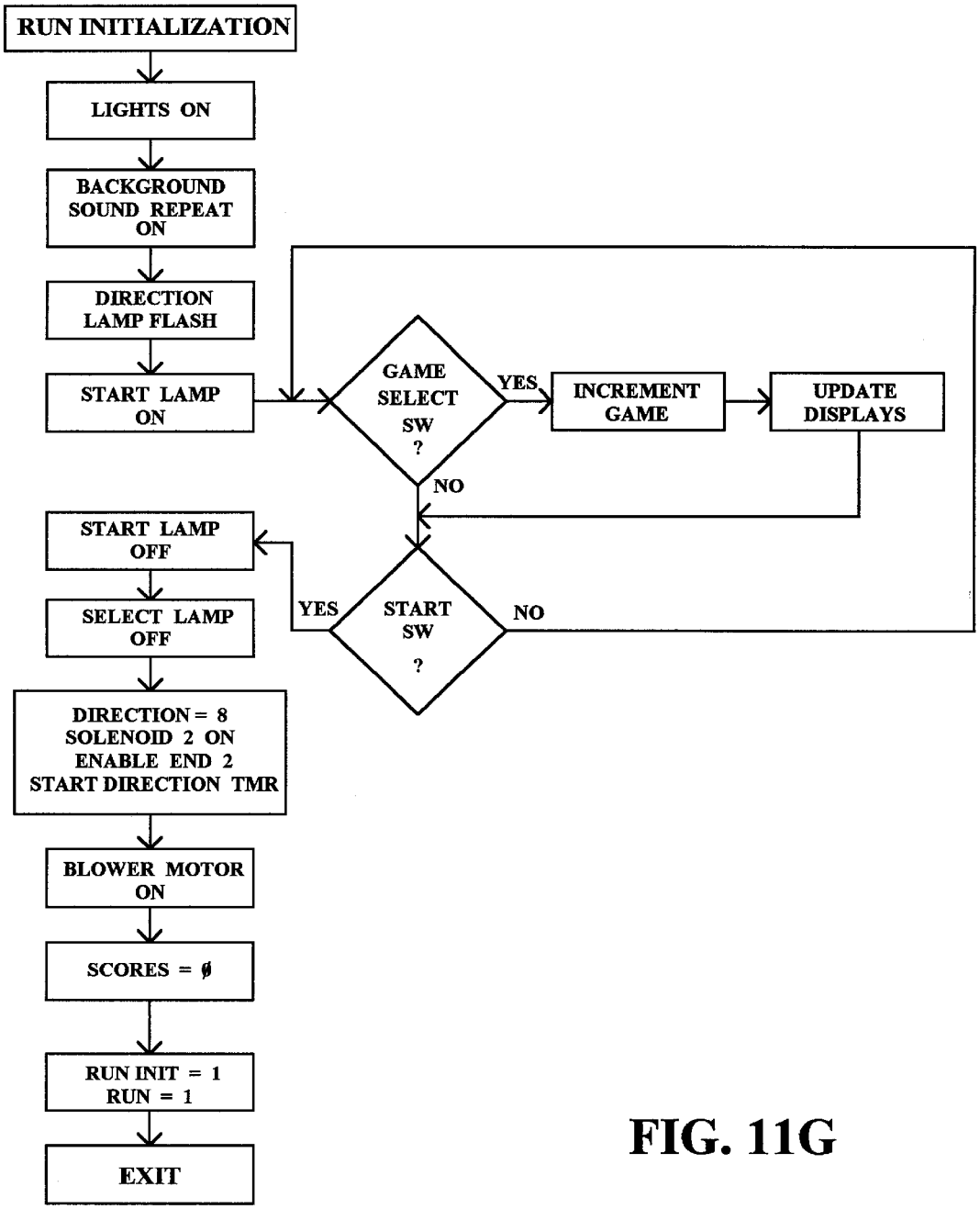

FIG. 11G depicts steps performed by the program in the course of initializing the RUN mode. The program changes the lights from a flashing mode of operation to a steady on state, initiates RUN mode background sound effects, causes the play direction switch lamp corresponding to the currently selected play direction to flash and turns on the game start switch lamp. The program then checks to see if the game selector switch has been operated by a player. If it has, the program increments the game from the currently selected game to the next game in the series of available games and updates the end zone display screens accordingly. Following incrementing of the game or if it was found that the game selector switch had not been operated the program checks to see if the game start switch has been operated by a player. If it has not, the program loops back and repeats the steps which began with checking for an operation of the game selector switch.

When operation of the game start switch is detected the program turns off the start switch lamp and the game selector switch lamp and establishes default conditions for the RUN mode of operation. In this example these conditions include selecting Play Direction 2, actuating Solenoid 2, enabling the End Zone 2 display and starting a direction timer which is internally configured within the data processor. The timer establishes a ten second period during which the program will not respond to another operation of a play direction selector switch. The program then turns the blower motor on, sets the player's current score values at zero and then proceeds with the RUN mode of operation as previously described.

Figure 11H:
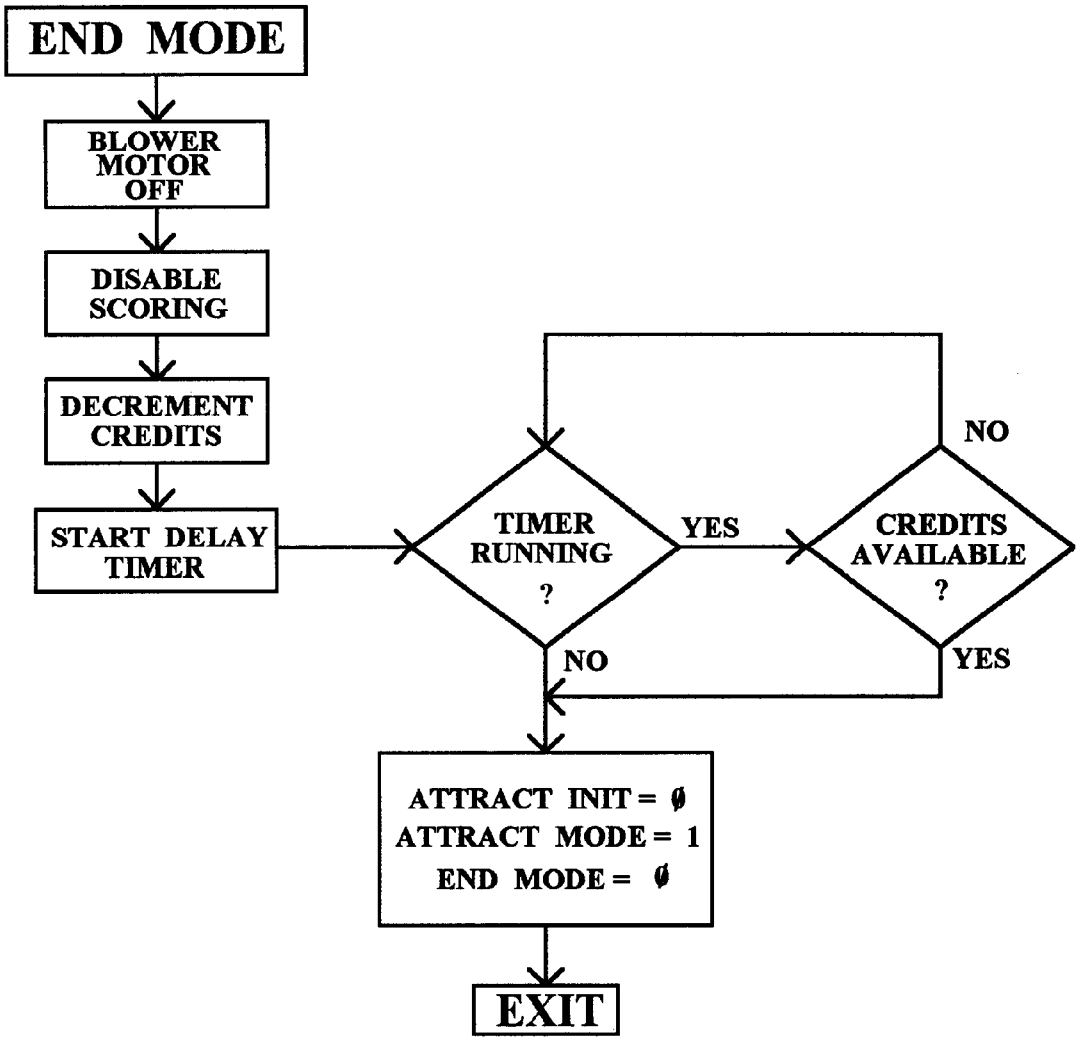

In the END mode of operation, with reference to FIG. 11H, the program turns the air blower motor off, disables the score counting operation, decrements the credit count and starts the delay timer running. The program then checks to see that the delay timer is running and if it is checks to see if there is remaining credit available. If there are no credits, the program loops back to the step of checking to see if the delay timer is running. The delay timer provides for a short delay to provide time for END mode operations to take place.

When the delay timer times out or if there is found to be available credit the program returns to the main program loop of FIG. 11A after enabling the ATTRACT mode and disabling the END mode.

Referring to FIG. 11I, the program responds to a system error by turning off all outputs, disabling the above described modes of operation and by initiating playing of an error message. The error message is repeated at intervals such as at 30 second intervals for example. Exit from the ERROR portion of the program occurs when the gaming apparatus is shut down by opening of the power on of switch.

Referring again to FIG. 10, the end zone display screen controllers 81 can be conditioned to display a particular one of the scoring zone patterns during the ATTRACT mode of operation or to display no pattern or to cycle rapidly and repetitively through all available patterns as a means of attracting interest.

Figure 12:
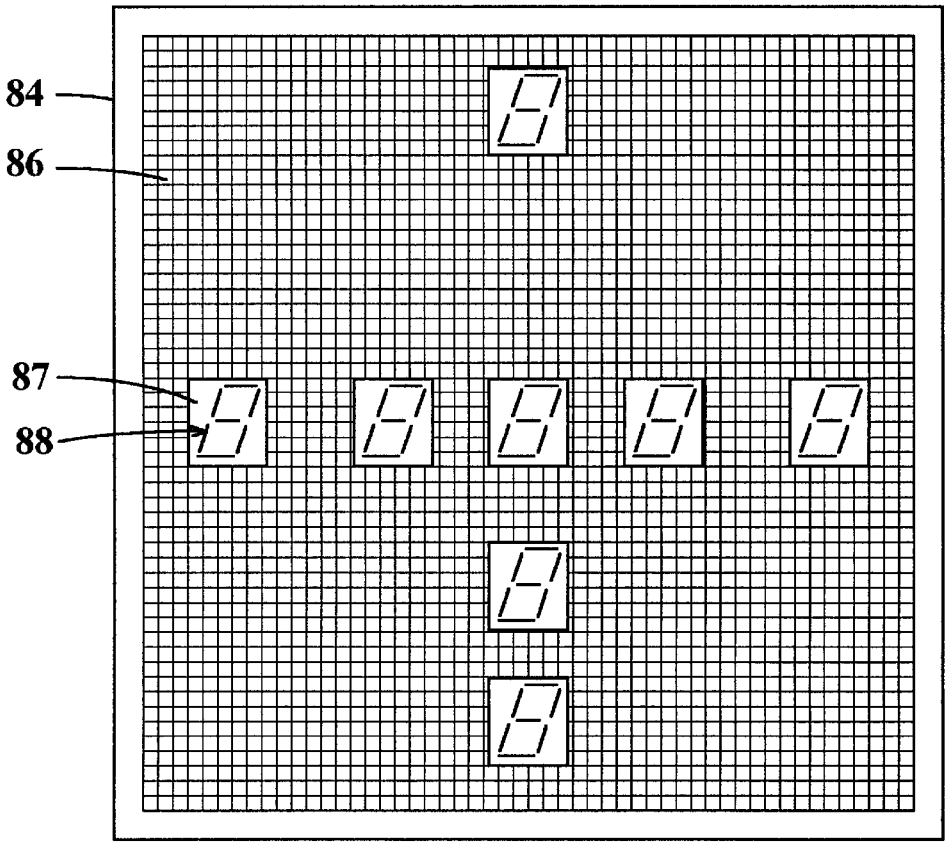
FIG. 12 is a top view of an alternate arrangement of electronic display screens for displaying scoring zone demarcations and score values in the apparatus of FIGS. 1 to 4.

FIG. 12 depicts an alternate electronic display screen arrangement which can produce any of the scoring zone patterns shown in FIGS. 7, 8 and. The basic display screen 84 of FIG. 12 is of the economical known type having rows and columns of small light sources 86 such as LEDs (light emitting diodes) which can be individually energized to form desired images. Display screen 84 is of square configuration and conforms in size with the scoring zones of the playing field board. Screen 84 is used to display the linear or circular demarcation lines, 29, 29*a*and 29*b* of FIGS. 7, 8 and 9. Referring again to FIG. 12, the same screen 84 can also be used to display the score value numerals but preferably sharper numeral images are produced by overlaying the screen 84 with additional smaller electronic display screens 87 situated at the locations where the numerals are to appear. The additional screens 87 are of the known segmented electrode type, widely used in hand held calculators and diverse other devices, which contain internal electrodes 88 arranged in the pattern of a slanted numeral 8. As is understood in the art, any digit from 0 to 9 can be imaged by energizing a different combination of the seven electrodes 88. Eight screens 87 of this kind, arranged as depicted in FIG. 12, can be used to produce each of the different score value numeral displays 31, 31*a* and 31*b* depicted in FIGS. 7, 8 and 9.

Referring again to FIG. 1, the shutting down of the airflow at the playing field board 19 after a player reaches a winning score or after a maximum playing time has elapsed functions to prevent playing or practicing of the game before and after a paid for period of play. The game cannot be played in a normal manner in the absence of an upward air flow from the playing field board surface.

While the invention has been described with reference to certain preferred embodiments for purposes of example, many modifications and variations are possible and it is not intended to limit the invention except as defined in the following claims.

We claim:

1. Gaming apparatus having an elongated playing field board with a horizontal upper surface along which a player propels a play piece, said playing field board having a play piece travel zone along which the play piece travels and wherein said travel zone extends between first and second end zones at which the play piece may come to rest on said upper surface, different areas within each of said end zones having different scoring values:

said playing field board being penetrated by an array of spaced apart airflow apertures which are situated at said travel zone and at each of said end zones, said gaming apparatus further including three air blowers having airflow outlets communicated with said airflow apertures to cause outflows of air at said upper surface through said apertures, a first of said air blowers being communicated with ones of said airflow apertures which are at said first end zone, a second of said air blowers being communicated with ones of said airflow apertures which are at said second end zone, and a third of said air blowers being communicated with ones of said airflow apertures which are at said travel zone.

2. Gaming apparatus having an elongated playing field board with a horizontal upper surface along which a player propels a play piece, said playing field board having a play piece travel zone along which the play piece travels and wherein said travel zone extends between first and second end zones at which the play piece may come to rest on said upper surface, different areas within each of said end zones having different scoring values, said playing field board being penetrated by an array of spaced apart airflow apertures which are situated at said travel zone and at each of said end zones, said gaming apparatus further including at least one air blower having an airflow outlet communicated with said airflow apertures to cause an outflow of air at said upper surface through said apertures, wherein said playing field board forms the top of a plenum chamber which has a first region situated below said first end zone and a second region situated below said second end zone and a third region situated below said play piece travel zone, said airflow outlet of said air blower being communicated with said third region of said plenum chamber, said first second and third regions being isolated from each other by a pair of partitions each of which has at least one airflow opening therein, further including a pair of airflow gates each being situated at a separate one of said partitions to enable selective blockage of airflow through the partition, further including an interlock connected to each of said airflow gates and which closes either of said gates when the other thereof is open.

3. Gaming apparatus having an elongated playing field board with a horizontal upper surface along which a player propels a play piece, said playing field board having a play piece travel zone along which the play piece travels towards a first end zone at which the play piece may come to rest on said upper surface, different areas within said first end zone having different scoring values, wherein the improvement comprises:

at least a portion of said playing field board being penetrated by an array of spaced apart airflow apertures, said gaming apparatus further including at least one air blower having an airflow outlet communicated with said airflow apertures to cause an outflow of air at said upper surface through said apertures, wherein at least a portion of said playing field board is formed of light transmissive material, further including at least one light source disposed beneath a light transmissive portion of said playing field board.

4. The gaming apparatus of claim 3 wherein said play piece is formed of light transmissive material.

5. The gaming apparatus of claim 3 wherein said play piece is formed of material which fluoresces in response to light.

6. Gaming apparatus having an elongated playing field board with a horizontal upper surface along which a player propels a play piece, said playing field board having a play piece travel zone along which the play piece travels towards a first end zone at which the play piece may come to rest on said upper surface, different areas within said first end zone having different scoring values, wherein the improvement comprises:

at least a portion of said playing field board being penetrated by an array of spaced apart airflow apertures, said gaming apparatus further including at least one air blower having an airflow outlet communicated with said airflow apertures to cause an outflow of air at said upper surface through said apertures, wherein said playing field board is a component of a playing table supported by at least a pair of downward extending legs which are formed at least in part of light transmissive material, further including light sources contained within said legs.

7. Gaming apparatus having an elongated playing field board with a horizontal upper surface along which a player propels a play piece, said playing field board having a play piece travel zone along which the play piece travels towards a first end zone at which the play piece may come to rest on said upper surface, different areas within said first end zone having different scoring values, wherein the improvement comprises:

at least a portion of said playing field board being penetrated by an array of spaced apart airflow apertures, said gaming apparatus further including at least one air blower having an airflow outlet communicated with said airflow apertures to cause an outflow of air at said upper surface through said apertures, wherein at least one visible demarcation divides said first end zone into areas of different score value, said demarcation being a changeable image generated by an electronic display screen which extends horizontally at said first end zone.

8. The gaming apparatus of claim 7 further including a display screen controller coupled to said electronic display screen and being conditioned to cause display of any selected one of a plurality of different demarcation patterns at said first end zone.

9. The gaming apparatus of claim 7 further including a display screen controller coupled to said electronic display screen and being conditioned to cause display of a changeable indication of the score value of each of said areas of different score value at said first end zone.

10. Gaming apparatus having an elongated playing field board with a horizontal upper surface along which a player propels a play piece, said playing field board having a play piece travel zone along which the play piece travels towards a first end zone at which the play piece may come to rest on said upper surface, different areas within said first end zone having different scoring values, wherein the improvement comprises:

at least a portion of said playing field board being penetrated by an array of spaced apart airflow apertures, said gaming apparatus further including at least one air blower having an airflow outlet communicated with said airflow apertures to cause an outflow of air at said upper surface through said apertures, wherein at least one visible demarcation divides said first end zone into areas of different score value, said demarcation being a changeable image generated by a first electronic display screen which extends horizontally at said first end zone, further including a plurality of additional electronic display screens of the segmented electrode type which display changeable numbers, said additional electronic display screens being positioned to display changeable score value numbers at said areas of different score value.

11. Gaming apparatus having an elongated playing field board with a horizontal upper surface along which a player propels a play piece, said playing field board having a play piece travel zone along which the play piece travels towards a first end zone at which the play piece may come to rest on said upper surface, different areas within said first end zone having different, scoring values, wherein the improvement comprises:

at least a portion of said playing field board being penetrated by an array of spaced apart airflow apertures, said gaming apparatus further including at least one air blower having an airflow outlet communicated with said airflow apertures to cause an outflow of air at said upper surface through said apertures, wherein at least a portion of said playing field board is formed of transparent material, further including at least one electronic display board for displaying a player's current score, said display board being situated under a transparent portion of said playing field board in position to be viewed therethrough.

12. Gaming apparatus comprising:

a plurality of play pieces for propelling along a playing field by a player, an elongated table having side portions and end portions bounding an elongated playing field region, a horizontal playing field board extending along said playing field region and being proportioned to be in spaced apart relationship with said side portions and end portions of said table to establish a slot which extends around said playing field board into which misdirected play pieces may drop from said playing field board, said playing field board having end zones at each end of the board at which play pieces may come to rest thereon, said playing field board being the top member of an air plenum chamber and being penetrated by an array of spaced apart airflow apertures situated at said end zones and extending therebetween, and at least one motor driven air blower having an airflow outlet communicated with said plenum chamber, wherein at least at least portions of the end regions of said playing field board are formed of transparent material and wherein demarcations visible at said end zones identify areas of different score value, said demarcations being changeable images produced by electronic display screens which face said end zones.

13. Gaming apparatus having an elongated playing field board with a horizontal upper surface along which a player propels a play piece towards an end zone on said board at which the play piece may come to rest on said upper surface thereof, said end zone having at least one visible demarcation dividing said end zone into areas of different score value, wherein the improvement comprises:

at least a portion of said playing field board which is at said end zone being formed of transparent material, said demarcation being a changeable image generated by an electronic display screen situated at said end zone.

* * * * *